US005656883A

United States Patent [19]

Christensen

[11] Patent Number: 5,656,883

[45] Date of Patent: Aug. 12, 1997

[54] FIELD EMISSION DEVICES WITH IMPROVED FIELD EMISSION SURFACES

[76] Inventor: Alton O. Christensen, 16106 S. Ravenswood Dr., Magnolia, Tex. 77355-1233

[21] Appl. No.: 692,591

[22] Filed: Aug. 6, 1996

[51] Int. Cl.[6] ..... H01J 1/02; H01J 1/16; H01J 19/10; H01J 1/14; H01J 19/06

[52] U.S. Cl. ..... 313/310; 313/336; 313/346 R

[58] Field of Search ..... 313/309, 310, 313/311, 336, 346 R, 351, 495; 445/50, 51

[56] References Cited

U.S. PATENT DOCUMENTS 4,498,952 2/1985 Christensen .
4,663,559 5/1987 Christensen .

FOREIGN PATENT DOCUMENTS 0228616 of 0000 European Pat. Off. .

*Primary Examiner*—Sandra L. O'Shea
*Assistant Examiner*—Mack Haynes
*Attorney, Agent, or Firm*—Gunn & Associates, P.C.

[57] ABSTRACT

This disclosure is directed toward field emission surfaces, and is more particularly directed toward improvements in cold, low field, high current, low noise field emission devices and surfaces. Such devices are used in field emission display devices such as video displays and information displays. The device utilizes a cermet with graded concentration of insulative and conductive particles deposited on the truncated point of a conical emitter. The emission surface of the cermet is insensitive to gases that oxidize or poison the emission surface. Such gases and other contaminants emanate from a phosphor when the emission device is used in phosphor display devices. The field emission device is operated at lower potentials thereby reducing power requirements and minimizing heat dissipation requirements. Further, the field emission device which operates at lower field in order to reduce mechanically and temporally unstable emission sites which result in current bursts and current deficits at these sites. Still further, the field emission device incorporates internal resistors which provide series resistance to limit noise at affected emission areas thereby eliminating the need to limit noise by incorporating high-valued resistors, typically in series with the cathode terminal of the emission device, which reduce the potential to the entire emission surface and increasing potentials required to produce current sufficient to excite display phosphor.

38 Claims, 1 Drawing Sheet

FIELD EMISSION DEVICES WITH IMPROVED FIELD EMISSION SURFACES

BACKGROUND OF THE DISCLOSURE

1. Field of the Invention

This disclosure is directed toward field emission surfaces, and is more particularly directed toward improvements in cold, low field, high current, low noise field emission devices and surfaces. Such devices are used in field emission display devices such as video displays and information displays.

2. Background of the Art

U.S. Pat. No. 4,663,559 and E.P.S. 0,228,616 B1, both to Alton O. Christensen (Christensen), disclose a field emission device which produces high current, low noise, low lateral energy, stochastic electron emission from a multiplicity of insulative particles subject to a field. The insulative particles are in and of a surface thickness comprised of a random mixture of insulative and conductive particles. Emission is achieved at applied potentials of about 5 volts which produce a field sufficient to emit electron currents of nanoamperes to milliamperes. Single devices or arrays of devices may be batch fabricated. Each device has an integral, implicitly self-aligned electron optic system comprising means for modulating, focusing and deflecting the formed current beam, and means for shielding the device from ambient magnetic fields.

The Institute of Electrical and Electronic Engineers (IEEE) sponsored annual International Vacuum Microelectronics Conference Proceedings, as well as many other publications in the art, are replete with many field emission materials, devices, and fabrication techniques. Worldwide field emitter development is recognized as having been fostered by the work of Spindt as disclosed in U.S. Pat. No. 3,755,704 as supported by Gray of NRL. Emphasis in the field, as reflected in recent conferences devoted to the technology, has been directed toward field emitters for excitation of phosphors to make information and video display products. Emission characteristics have been published for a wide variety of metals and metal compounds, such as borides, carbides, and nitrides. Field emission displays have been demonstrated, for example, by Coloray Inc., SRI, and PixTech Inc. using gated, pointy molybdenum metal emitters. Other developers have demonstrated field emission displays using pointy silicon emitters. SI Diamond, Inc. has demonstrated field emission displays using diamond-like carbon surfaces.

All prior art field emitters suffer from at least three or four significant deficiencies which affect the reliability and operating life when these devices are utilized in information or video displays. These deficiencies are summarized as follows:

(a) The emission surfaces oxidize and/or are poisoned by gasses within the display, or by gases generated by a phosphor used in the display thereby limiting the operating life of the emission device.

(b) The turn-on potentials and current modulating potentials are in the range of 25 to 300 volts. This range of potentials requires considerable power, dissipates considerable heat, and requires expensive high voltage control and address circuitry to operate the display device.

(c) The high fields in excess of $3\times10^9$ volts/meter, required for higher current emission, stress and tend to modulate the emitting surface thereby producing mechanically and temporarily unstable emission sites. This results in bursts and deficits of current from the emission sites.

(d) The stochastic nature of field emission, and added burst noise, requires incorporation of high-valued resistors added in series typically with the cathode terminal of the emitter to limit noise. Such resistors increase the potential required to produce currents required to excite display phosphors. Such resistors are inadequate since they reduce the potential to the entire emission surface, and not just to the emission area affected. The parasitic capacitance of the resistors together with the high value of series resistance produces a time constant delay in action that may well limit efficacy.

An object of this invention is to provide a field emission device with an emitter surface which is insensitive to gases that oxidize or poison the emission surface. Such gases and other contaminants emanate from a phosphor when the emission device is used in phosphor display devices.

Another object of the invention is to provide a field emission device that can be operated at lower potentials thereby reducing power requirements and minimizing heat dissipation requirements.

Still another object of the invention is to provide a field emission device which is operated at lower field in order to reduce mechanically and temporarily unstable emission sites which result in current bursts and current deficits at these sites. Even at reduced operating fields, the device emits current sufficient to operate display devices.

A still further object of the invention is to provide a field emission device which incorporates internal resistors which provide series resistance to limit noise at affected emission areas thereby eliminating the need to limit noise by incorporating high-valued resistors in series typically in series with the cathode terminal of the emission device thereby reducing the potential to the entire emission surface and increasing potentials required to produce current sufficient to excite display phosphor.

There are other objects and advantages of the present invention that will become apparent in the following disclosure.

SUMMARY OF THE PRESENT INVENTION

This disclosure teaches the improvement of operating efficiency and operating life of prior art field emitters. Field emission devices which utilize a cermet as an emitter are disclosed in the previously referenced U.S. Pat. No. 4,663,559 and E.P.S. 0,288,616 B1 to Christensen, which are assigned to the assignee of the present disclosure and which are incorporated into this disclosure by reference. With these devices, emission is obtained from a multiplicity of $SiO_2$ and $Cr_3Si$ sites. The average barrier to emission varies between 0.8 eV and 2.3 eV, depending upon the applied potential, the percentage of emission area occupied by $SiO_2$, and the operative field factor for $Cr_3Si$ sites between $SiO_2$ sites.

This invention extends the prior art of Christensen cermet field emitter. Briefly, the invention provides:

(a) an emission device with an emitter surface of thickness which is about the electron ballistic transport length therein, thereby providing an emission surface which is insensitive to gases that oxidize or poison the emission surface and which is not detrimental to current emission;

(b) an alternate metal to $Cr_3Si$ for the cermet of insulative particles (preferably $SiO_2$) and conductive particles, which is preferably $Al_2Li_3$ thereby lowering the operating potential required to operate the device such that sufficient current is emitted to activate a phosphor display; and (c) other qualified materials of characteristics similar to $SiO_2$ to form a co-deposited, graded cermet with $Cr_3Si$ and $Al_2Li_3$.

The emission cermet is comprised of an increasing percentage of $SiO_2$ which is co-deposited with a decreasing percentage of the metal $Cr_3Si$ or $Al_2Li_3$. The bulk resistivity of both $Cr_3Si$ and $Al_2Li_3$ are many times greater that the resistivity of Al alone. Within the cermet, the graded co-deposition produces reduced cross sections of $Cr_3Si$ or $Al_2Li_3$ which form M paths of high resistance, low RC time constant connection to N possible sites of the emission surface. These paths form the internal resistors which provide series resistance to limit noise at affected emission areas thereby eliminating the need to limit noise by incorporating high-valued resistors in series typically in series with the cathode terminal of the emission device, thereby reducing the potential to the entire emission surface and increasing potentials required to produce current sufficient to excite display phosphor.

The emission surface is formed as a contiguous layer on the side of the deposited cermet in which the $SiO_2$ concentration is increasing and the concentration of conductive particles is decreasing. The emission surface is deposited at the time of cermet deposition and is an integral part of the graded cermet. The surface is, in fact, an extension of the particle gradation within the cermet and is a later of 100 percent insulative particles which are preferably $SiO_2$ (silica). For purposes of discussion, however, the emission surface will sometimes be referred to in the context of a separate layer. The emission surface is at least one atomic layer thick and is preferably about the thickness of the electron ballistic transport length therein. That electron ballistic transport length is greater when the cermet metal is $Al_2Li_3$ since the work function is about 1.5 eV less than the 2.54 eV work function of $Cr_3Si$, and uses less of the electron temperature limit of ballistic transport. The use of $Al_2Li_3$ thereby lowers the operating potential required to operate an emission device employing the cermet such that sufficient current is emitted to activate a phosphor display. The silica emission surface is insensitive to gases that oxidize or poison the emission surface. As an example, such gases and contaminants emanate from phosphors in field emission display devices.

In the preferred embodiment, as in the devices disclosed in the Christensen references, emission of microampere currents from N regions of the emission surface is obtained from the conduction band of $SiO_2$ of emission barrier less that 1 eV at fields of the order of $5\times10^8$ to $7\times10^8$ volts/meter for applied gate potentials of 3.5 to 5 volts. Such low fields are not sufficient to mechanically or temporally modulate the emission surface and thereby create unwanted bursts or deficits in currents. As discussed previously, such emission current bursts and deficits are prevalent in prior art emission devices.

Deposited upon any organic or inorganic conductor, or upon n-type wide and medium band gap materials, the cermet reduces their respective emission barriers of 3 to 5 eV to less than 1 eV. The $SiO_2$—$Cr_3Si$ cermet deposited upon n-silicon emitters reduces their emission barrier from about 4 eV to less than 1.5 eV, which is the sum of 0.55 eV $Cr_3Si$ metal-silicon barrier and the less than 1 eV conduction band width of $SiO_2$.

The noise reduction achieved by the previously described cermet resistances, together with the multiplicity of emission sites of the emission surface, increases the current-plus noise to noise ratio by at least 10 log N decibels over all prior art emitting surfaces.

Attention is briefly directed toward the preferred metals of the cermet. $Al_2Li_3$ has a work function of 1.06 eV and, like $Cr_3Si$, makes ohmic contact to $SiO_2$. $Al_2Li_3$ also makes ohmic contact to all n-type medium and high band gap materials, organics, metal borides, carbides and nitrides. $Al_2Li_3$ is highly reactive and must have its open surface passivated by $SiO_2$, as is the case of the cermet with the 100% $SiO_2$ emission surface of the disclosed invention. The reactivity of $Al_2Li_3$ also serves to form an ohmic contact with diamond and diamond like carbon as alternate materials for the $SiO_2$ insulative particles.

Attention is next briefly directed toward the insulative component of the cermet. Although $SiO_2$ is the preferred material for the insulative component of the emission surface and graded portion of the cermet, any material having characteristics similar to $SiO_2$ can be used. $SiO_2$ passivates $Al_2Li_3$, has an electron mobility of about $3\times10^5$ meter$^2$ per volt-second, and has a conduction band width of less than 1 eV. Organic compounds, or metal borides, carbides, or nitrides qualified for use in the cermet of the present invention, have resistance to oxidation and contamination, electron mobility, 1 eV or less conduction band width, and, if required, passivate $Al_2Li_3$.

BRIEF DESCRIPTION OF THE DRAWINGS

So that the manner in which the above recited features, advantages and objects of the present invention are obtained and can be understood in detail, more particular description of the invention, briefly summarized above, may be had by reference to the embodiments thereof which are illustrated in the appended drawings.

DETAILED DESCRIPTION OF THE PREFERRED EMBODIMENTS

Figure 1:
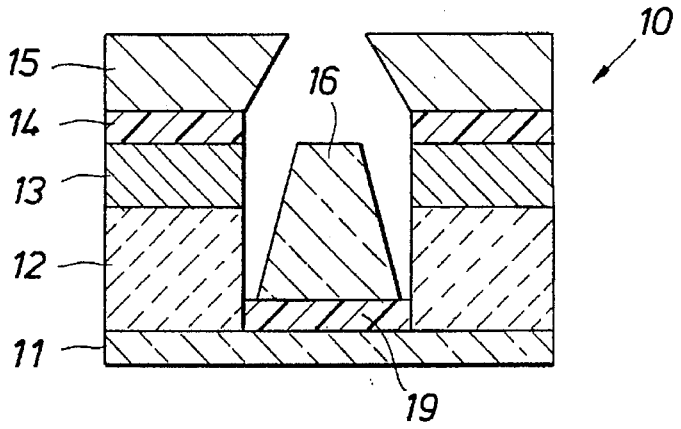
FIG. 1 (PRIOR ART)
FIG. 1 is a partial section view of a prior art gated field emission device, with its series current limiting resistance, in the process of emitter deposition.

Attention is first directed to FIG. 1 which is a partial section view of a prior art gated field emission device, with its series current limiting resistance, in the process of emitter deposition. The structure, generally denoted by the numeral 10, is in process of fabrication. The inventor makes no claims concerning this illustration of prior art. FIG. 1 illustrates a step in the fabrication process after, but not limited to, the previously cited U.S. Pat. No. 3,755,704 reference to Spindt wherein an emitter material 15 is molybdenum which is deposited at grazing incidence to form a conical shaped emitter 16.

Still referring to FIG. 1, the device 10 is formed on a substrate metal 11 which serves as the cathode for the device and which interconnects the device to the cathode of similar devices. A device surrounding gate is denoted by the numeral 13 and comprises metal. An oxide layer 12 contacts the substrate 11 and the gate 13 and electrically isolates the gate 13 from the substrate 11. A layer 14 is a layer of metallic or insulative material and serves a sacrificial parting layer in the manufacture of the device as will be illustrated in subsequent discussion. The layer 15 is excess emitter metal deposited in the formation of the emitter 16. A layer 19 functions as the previously discussed series resistor substrate-to-cathode of prior art devices required to control emitter current bursts and emitter current deficits. The layer 19 is, of course, formed of highly resistive material.

In the case of the device of FIG. 1 wherein 16 is a semiconductor, such as silicon, substrate 11 is also a semiconductor. In this case, the emitter 16 is formed by the etching of it semiconductor substrate 11, and layers 14 and 15 are absent.

Figure 2:
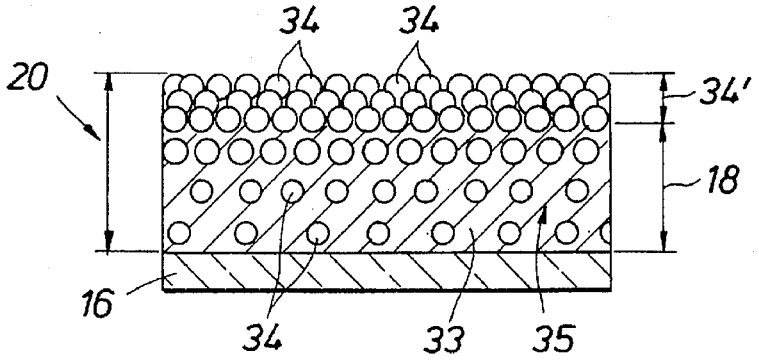
FIG. 2 is a sectional view of the cermet and emission surface of the present invention showing built-in current limiting resistances.

The cermet device of the present invention is shown in FIG. 2 and is generally denoted by the numeral 20. The cermet is shown deposited on the emitter 16 and, as discussed previously, comprises a co-deposited, graded composition of metallic material 33 and insulative material 32, and a layer 34 of insulative material which forms the emission surface of the cermet. The metal is preferably particles of $Cr_3Si$ or alternately $Al_2Li_3$. The insulative material is preferably particles of $SiO_2$. The concentration of $SiO_2$ particles increases toward the layer 34 while the concentration of metal increases toward the emitter 16. The co-deposited, graded portion 18 of the cermet and emission surface layer 34 are actually deposited on the emitter with the same graded deposition operation, with the concentration of deposited $SiO_2$ particles being increased as the cermet is built upon the emitter 16 until no metal 33 is being deposited and only $SiO_2$ 32 is being deposited thereby producing the oxide layer 34. This final oxide surface layer 34 has a thickness 34' of the electron ballistic transport length in $SiO_2$ of about 5 nanometers (mm), such that the thickness 34' is several atomic layers of $SiO_2$. $Al_2Li_3$, used as metal 33 in the cermet portion 18 to produce ohmic contact to medium band-gap materials and diamond-like carbon, requires overlayer passivation such as provided by the layer 34 of $SiO_2$. This layer forms the silica emission surface which is insensitive to gases that oxidize or poison the emission surface, such gases and contaminants emanate from phosphors in field emission display devices.

Deposition of the cermet is accomplished from two cooperating deposition sources, each with independently controlled energies and rates of deposition. With independent control of the deposition sources, the grading of the cermet portion 18 as to percentages of oxide and metal, and the size of the particles being deposited, can be precisely controlled. Furthermore, the thickness 34' of the oxide layer 34 can be precisely controlled. Dual ion beams have been used as deposition sources to deposit the cermet 20 upon the depositional surface 16. The co-deposition is better accomplished by atomic layer epitaxy, which allows the composition of the cermet to be varied in each successively formed atomic layer, starting with a layer of 100% metal 33 contacting the deposition surface 16 and terminating with a layer 34 of 100% oxide forming an emission surface.

Still referring to FIG. 2, the numeral 35 indicates a typical conducting, resistive channels of metal 33 which exhibit decreased cross section and length. As shown in FIG. 2, these channels extend from the emitter 16 to the layer 34. The resistivities of the preferred cermet metals 33, which are $Cr_3Si$ and $Al_2Li_3$, are many times greater than aluminum. These constricted conduction channels, typified by the numeral 35, function as current limiting resistors within the cermet to particular areas of emission on the surface of the layer 34. This results in the suppression of emission current bursts and emission current deficits. The resistors 19 required in prior art devices (see FIG. 1) reduces the potential to the entire emission surface. These prior art devices, when used as an example in screen display applications, require increased operating potentials to produce emission currents sufficient to excite display screen phosphors.

Focusing again on the resistor channels 35, the cermet device shown in FIG. 2 present invention exhibits a significant improvement over the prior art devices represented in FIG. 1 in that current limiting of the present invention tends to (a) stabilize the current of a particular area of the surface of the emission layer 34 and not of the entire emission surface as is the case of the prior art devices, and (b) decrease the noise component in the emitter current, acting with very short time constant, and may well eliminate the need for external resistors 19 used in emitters described in the prior art literature. The current limiting resistors' magnitude may be increased by increasing the initial percentage of the oxide in the cermet thereby further constricting the cross sections of the limiting resistor paths 35. In summary, emission devices employing the cermet and internal, site specific resistor channels 35 of the present invention can be operated at lower operating potentials therefore reducing power requirements and heat dissipation requirements.

Figure 3:
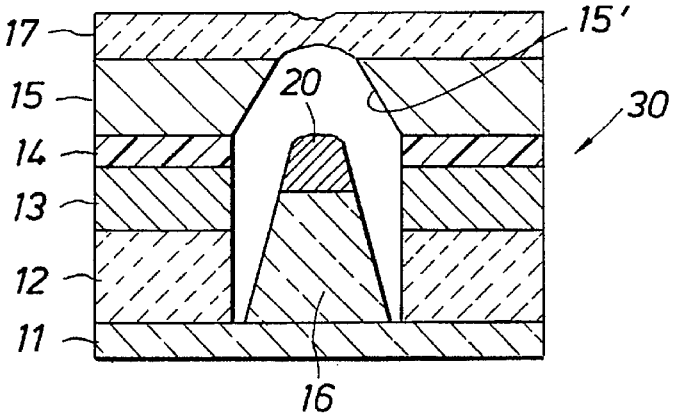
FIG. 3 is a sectional view of in-process addition of the cermet and emission surface to a typical prior art emitter.

Attention is now drawn to FIGS. 2 and 3. FIG. 3 shows a field emission device 30 in the process of fabrication. The layers of material 11, 12, 13, 14 and 15 have been discussed previously. The emitter 16 is formed in the shape of a pyramid or preferably a cone with the point of the cone truncated to receive the cermet material 20. The cermet includes the graded region 18 and the emission surface 34 as shown in FIG. 2. Co-deposition of the insulative and conductive particles of the cermet is initiated, and deposits of cermet mixture are formed on the truncated point of the emitter 16 as well as on the layer 15 as excess cermet material 17. The previously discussed deposition of the emitter 16 at grazing incidence produced the excess layer 15 of emitter material with an aperture 15' with conical shaped walls as shown in FIG. 3. Deposition of the cermet material upon the emitter 16 continues through the aperture 15' until the aperture is closed with cermet material 17. The cermet material deposited upon the emitter 16 is essentially conical in shape, with the graded region 18 of the cermet being passivated by the emission layer 34.

Figure 4:
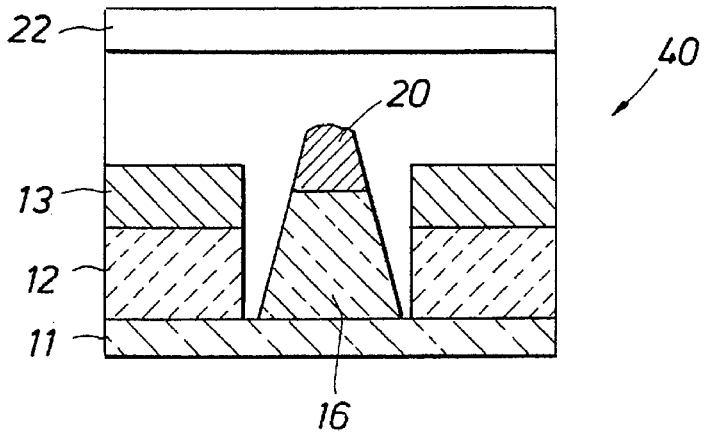
FIG. 4 is a sectional view of an improved emission surface on a field emission device.

Referring now to both FIG. 3 and FIG. 4, the layers 17 and 15 are removed by dissolution of the sacrificial layer 14, thereby producing a truncated conical emitter 16 with and essentially conical cermet 20 as shown in FIG. 4.

If the emitter material 16 is etched silicon, then the layer 15 is not present. Using as an example a device of the type shown in FIG. 1 wherein 16 is a semiconductor, such as silicon, and substrate 11 is also a semiconductor. In this case, the emitter 16 is formed by the etching of it semiconductor substrate 11, and layers 14 and 15 are absent.

The function of the emitter 16 of the previously described field emission structure can be varied depending upon the type or classification of the structure. More specifically, the specification of the element 16 depends upon whether the element is to be operated:

(a) as a surface emitter itself, wherein the material of 16 is a low resistance interconnected metal such as copper or aluminum;

(b) as an improvement to a metal emitter 16, such as molybdenum, shown in FIGS. 2, 3, and 4;

(c) as an improvement to a silicon emitter as shown in FIGS. 2 and 4;

(d) as an improvement to emitter materials such as diamond or diamond-like carbon n-doped and contacted by $Al_2Li_3$ as shown in FIGS. 2, 3, and 4; or (e) as an improvement to emission of metal nitrides or metal carbides and the like as shown in FIGS. 2, 3 and 4.

FIG. 4 illustrates an example of an improved field emission device as taught by this disclosure. The device is indicated as a whole by the numeral 40. It comprises an essentially conical cermet 20 comprising a graded region 18 and an emission layer 34 (see FIG. 2). The cermet is deposited upon the truncation of the conical emitter 16 which is electrically connected to a metallic substrate 11. The element 13 is a gate with a preferably cylindrical aperture within which the emitter 16 and cermet 20 are centered. The layer 12 is an oxide layer which isolates the gate 13 from the substrate 11.

Still referring to FIG. 4, the element 22 represents a phosphor in the case where the field emission device is used in a display device. More specifically, a typical display device comprises a multiplicity of field emission devices sharing a common substrate 11 and each directed toward an assigned target area of the phosphor 22. Integrated circuit control means supported by the common substrate 11 are used to control the multiplicity of field emission devices as disclosed in the previously cited references of Christensen.

The field emission device 40 can be used in one of various types of r-f amplifiers. In this application, the element 22 in FIG. 4 represents the anode of the device 40.

The foregoing disclosure is directed toward the preferred embodiments of the invention, but the scope of the invention is defined by the claims which follow.

What is claimed is:

1. A field emission device forming emission from particles of insulative material under the influence of a field, comprising:

(a) a substrate;

(b) an emitter above said substrate;

(c) a gate electrode;

(d) a dielectric layer disposed between said gate electrode and said substrate; and (e) a cermet deposited on said emitter thereby forming an interface to said emitter and an emission surface, wherein a barrier to emission is the conductive band width and is less than about 1 eV, and wherein said cermet comprises conductive and insulative particles arranged in a graded distribution with relative concentration of said insulative particles increasing with distance from said interface, and wherein ohmic contact exists between the conductive and insulative particles.

2. The device of claim 1 wherein said concentration of insulative particles increases to form an emission surface comprises a layer of insulative particles with a thickness of at least one atomic layer, and wherein said gate electrode surrounds said emission surface.

3. The device of claim 2 wherein said thickness is the ballistic transport length of said insulative material.

4. The device of claim 1 wherein said emitter comprises semiconductor material.

5. The device of claim 1 wherein said insulative material is $SiO_2$.

6. The device of claim 5 wherein the diameter of said particles of $SiO_2$ is about 5 nm.

7. The device of claim 1 wherein said conductive particles are $Cr_3Si$.

8. The device of claim 1 wherein said conductive particles are $Al_2Li_3$.

9. The device of claim 2 wherein said emitter comprises copper, aluminum, molybdenum, diamond, carbon n-doped, $Cr_3Si$, metal nitride, or metal carbide.

10. The device of claim 2 wherein:

(a) said graded distribution forms channels of conductive particles;

(b) said channels have decreasing cross sections and lengths as the distance from said interface increases;

(c) wherein said channels intersect said emission surface; and (d) said channels act as current limiting resistors to particular areas of said emission surface.

11. The device of claim 2 wherein said emitter is formed on a metal substrate in the form of a pyramid or cone having a truncated top, and wherein said cermet is formed on said truncation.

12. The device of claim 2 wherein said layer of insulative particles passivates said conductive particles within said cermet.

13. A field emission device comprising:

(a) a conductive substrate;

(b) an emitter formed in the shape of a truncated pyramid or truncated cone with a base surface and a truncation surface, wherein said emitter is conductively connected at said base surface to said conductive substrate;

(c) a cermet conductively connected to said truncation surface of said emitter thereby forming a cermet-truncation surface interface and an emission surface, wherein said cermet comprises conductive and insulative particles in a graded distribution with increasing concentration of insulative particles toward said emission surface, and wherein emission is obtained from said particles of insulative material, and wherein a barrier to emission is the conductive band width and is less than about 1 eV, and wherein ohmic contact exists between said conductive and insulative particles;

(d) a gate which surrounds said cermet, wherein a potential is applied between said substrate and said gate causing electrons to flow from said insulative particles; and (e) a dielectric layer disposed between said gate and said substrate.

14. The device of claim 13 wherein said emission surface comprises a layer of insulative particles with a thickness of at least one atomic layer.

15. The device of claim 14 wherein the thickness of said layer of insulative particles is the ballistic transport length of the insulative particle material.

16. The device of claim 13 wherein said emitter comprises semiconductor material.

17. The device of claim 14 wherein said insulative material is $SiO_2$.

18. The device of claim 17 wherein said thickness is about 5 nm.

19. The device of claim 13 wherein said conductive particles are $Cr_3Si$.

20. The device of claim 13 wherein said conductive particles are $Al_2Li_3$.

21. The device of claim 14 wherein;

(a) said graded distribution forms channels of conductive particles;

(b) said channels have decreasing cross section and length as their distance with respect to said emission surface decreases;

(c) wherein said channels intersect said emission surface, (d) said channels act as current limiting resistors to particular areas of said emission surface.

22. The device of claim 14 wherein said conductive particles are $Al_2Li_3$ and said layer of insulative particles passivates said $Al_2Li_3$ particles within said cermet.

23. The device of claim 13 further comprising a structure positioned above said cermet wherein said electrons flow from said insulative particles to said structure.

24. The device of claim 23 wherein said structure comprises a phosphor.

25. The device of claim 23 wherein said field emission device is used as an r-f amplifier and said structure is the anode of said field emission device.

26. A multiplicity of field emission devices of claim 13 sharing a common substrate, each directed to an assigned area of electron emission.

27. An emission surface device comprising:

(a) an emission layer which provides an emission surface; and (b) a cermet which contacts said emission layer;

(c) wherein emission is obtained from particles of insulative material under the influence of a field;

(d) wherein said insulative particles are arranged with conductive particles in a graded distribution within said cermet with increasing concentration of said particles of insulative material toward said emission layer; and (e) wherein ohmic contact exists between the particles.

28. The device of claim 27 wherein a barrier to emission is the conductive band width and is less than about 1 eV.

29. The device of claim 27 wherein said emission layer is a layer of insulative particles with a thickness of at least one atomic layer and wherein the concentration of insulative particles within said cermet increases toward said contact of said cermet and said emission layer.

30. The device of claim 27 wherein said thickness is the ballistic transport length of said insulative material.

31. The device of claim 27 wherein said insulative material is $SiO_2$.

32. The device of claim 31 wherein the diameter of said insulative particles of $SiO_2$ is about 5 nm.

33. The device of claim 27 wherein said conductive particles are $Cr_3Si$.

34. The device of claim 27 wherein said conductive particles are $Al_2Li_3$.

35. The device of claim 27 wherein said graded distribution forms channels of conductive particles, wherein said channels have decreasing cross sections and lengths as their distance with respect to said emission layer decreases, and wherein said channels intersect said emission layer, and wherein said channels act as current limiting resistors to particular areas of said emission surface.

36. A field emission device forming emission from particles of insulative material under the influence of a field, comprising:

(a) a substrate;

(b) an emitter above said substrate;

(c) a gate electrode;

(d) a dielectric layer disposed between said gate electrode and said substrate; and (e) a cermet deposited on said emitter thereby forming an interface to said emitter and an emission surface, (f) wherein a barrier to emission is the conductive band width and is less than about 1 eV, (g) wherein said cermet comprises said insulative particles and further comprises conductive and insulative particles arranged in a graded distribution with relative concentration of said insulative particles increasing with distance from said interface, (h) wherein said concentration of insulative particles increases to form an emission surface comprising a layer of insulative particles with a thickness of at least one atomic layer, (i) wherein ohmic contact exists between the conductive and insulative particles, and (j) wherein said graded distribution forms channels of conductive particles, and (i) said channels have decreasing cross sections and lengths as the distance from said interface increases, (ii) said channels intersect said emission surface, and (iii) said channels act as current limiting resistors to particular areas of said emission surface.

37. A field emission device comprising:

(a) a conductive substrate;

(b) an emitter formed in the shape of a truncated pyramid or truncated cone with a base surface and a truncation surface, wherein said emitter is conductively connected at said base surface to said conductive substrate;

(c) a cermet conductively connected to said truncation surface of said emitter thereby forming a cermet-truncation surface interface and an emission surface, wherein said cermet comprises conductive and insulative particles, said particles are distributed within said cermet in a graded distribution with increasing concentration of insulative particles toward said emission surface, said emission surface comprises a layer of insulative particles with a thickness of at least one atomic layer, emission is obtained from said particles of insulative material, a barrier to emission is the conductive band width and is less than about 1 eV, ohmic contact exists between said conductive and insulative particles, said graded distribution forms channels of conductive particles, said channels have decreasing cross section and length as the distance from said emission surface decreases;

said channels intersect said emission surface, and said channels act as current limiting resistors to particular areas of said emission surface;

(d) a gate which surrounds said cermet, wherein a potential is applied between said substrate and said gate causing electrons to flow from said insulative particles; and (e) a dielectric layer disposed between said gate and said substrate.

38. An emission surface device comprising:

(a) an emission layer which provides an emission surface; and (b) a cermet which contacts said emission layer;

(c) wherein emission is obtained from particles of insulative material under the influence of a field;

(d) wherein said insulative particles are arranged with conductive particles in a graded distribution within said cermet with increasing concentration of said particles of insulative material toward said emission layer;

(e) wherein said graded distribution forms channels of conductive particles, wherein said channels have decreasing cross sections and lengths as their distance from said emission layer decreases, and wherein said channels intersect said emission layer, and wherein said channels act as current limiting resistors to particular areas of said emission surface; and (f) wherein ohmic contact exists between the particles.

* * * * *